US008047971B2

(12) United States Patent
Parker

(10) Patent No.: US 8,047,971 B2
(45) Date of Patent: Nov. 1, 2011

(54) DUMBBELLS WITH CONNECTIONS FOR A BARBELL

(75) Inventor: Larry Parker, Huntsville, AL (US)

(73) Assignee: Precision Athletics, LLC, Huntsville, AL (US)

( * ) Notice: Subject to any disclaimer, the term of this patent is extended or adjusted under 35 U.S.C. 154(b) by 59 days.

(21) Appl. No.: 12/022,262

(22) Filed: Jan. 30, 2008

(65) Prior Publication Data

US 2009/0192027 A1 Jul. 30, 2009

(51) Int. Cl.
*A63B 21/00* (2006.01)

(52) U.S. Cl. ..... 482/104; 482/105; 482/107

(58) Field of Classification Search ..... 482/104–108
See application file for complete search history.

(56) References Cited

U.S. PATENT DOCUMENTS

| | | | | |
|---|---|---|---|---|
| 3,134,590 | A | 5/1964 | Young | |
| 4,893,810 | A | 1/1990 | Lee | |
| 4,948,123 | A | 8/1990 | Schook | |
| 5,033,740 | A | 7/1991 | Schwartz et al. | |
| 5,090,693 | A | 2/1992 | Liang | |
| 5,102,124 | A | 4/1992 | Diodati | |
| 5,131,898 | A | 7/1992 | Panagos | |
| 5,163,887 | A | 11/1992 | Hatch | |
| 5,295,934 | A | 3/1994 | Collins et al. | |
| 5,421,797 | A | 6/1995 | Fletcher | |
| 5,464,379 | A | 11/1995 | Zarecky | |
| 5,496,243 | A | 3/1996 | Allen | |
| 5,531,657 | A | 7/1996 | Macedo | |
| 5,628,716 | A | 5/1997 | Brice | |
| 6,007,268 | A * | 12/1999 | Whittington et al. | 403/328 |
| 6,059,700 | A | 5/2000 | Ellenburg | |
| 6,592,499 | B2 | 7/2003 | Parker | |
| 6,875,161 | B1 | 4/2005 | Brice | |
| 6,939,276 | B2 * | 9/2005 | Gates | 482/111 |
| 7,131,938 | B2 | 11/2006 | Cao | |
| 7,182,716 | B1 | 2/2007 | Dawson | |
| 7,201,711 | B2 | 4/2007 | Towley, III et al. | |
| 2004/0162197 | A1 | 8/2004 | Towley, III et al. | |
| 2006/0105891 | A1 | 5/2006 | Cappellini et al. | |
| 2006/0172871 | A1 | 8/2006 | Cao | |
| 2007/0042879 | A1 | 2/2007 | Panagos | |

OTHER PUBLICATIONS

Written opinion PCT/US2009/032300, WO.

* cited by examiner

*Primary Examiner* — Jerome W Donnelly
(74) *Attorney, Agent, or Firm* — Mark Swanson; Frank M. Caprio; Bradley Arant Boult Cummings

(57) ABSTRACT

At least two dumbbells are releasably connected to the axial ends of a barbell. The dumbbells include a dumbbell connector portion positioned axially on a weight of the dumbbell, and the barbell includes a barbell connector portion on the axial ends of the barbell. The dumbbell connector portion engages the barbell connector portion to connect the dumbbell to the barbell. The dumbbell connector portion can be received in a recess of the weight. The user selects two dumbbells of a desired weight and connects the barbell with the dumbbells. The device is then utilized for exercise.

16 Claims, 3 Drawing Sheets

DUMBBELLS WITH CONNECTIONS FOR A BARBELL

BACKGROUND OF THE INVENTION a. Field of the Invention

This invention relates to dumbbells and barbells used for exercising with weights.

b. Description of Related Art

Weights have been used for exercising for many years. There are several different kinds of weights, such as free weights and weight machines. Dumbbells are a type of free weight which are designed to be used with only one hand. Frequently two dumbbells will be used together with one dumbbell being grasped in each hand of the person exercising. Another type of free weight includes barbells. The term barbell refers to a bar or rod which usually has weights attached on both ends. The user generally grabs the barbell with both hands and lifts and maneuvers the barbells.

Barbells usually are adjustable, wherein the user selects the amount of weight and then loads the weight on to the barbell. Frequently the weights are cylindrical with a hole in the middle, wherein the barbell is slid through the hole until the weight abuts against an inner collar near one side of the barbell. After the desired amount of weight is slid up against the inner collar, an outer collar is slid against the weights to abut the weights opposite the inner collar. Therefore, the weights on the barbell are held in place between the inner and outer collar. This is done on both sides of the barbell so the weight is evenly balanced. Many barbells have a length of 32 inches between the two inner collars. There are many varieties of collars and weights which can be used with barbells. One example includes threaded barbells, wherein the outer collar is corresponding threaded and twists onto the barbell until it is locked into position.

Some dumbbells have adjustable weights, whereas other dumbbells are designed for a fixed weight. With the adjustable weight dumbbells, the user selects the amount of weight and then secures this weight to the dumbbell, similar to the barbell. Dumbbells which have a fixed weight are generally provided in a set so that the user will select the amount of weight he wants to exercise with and picks dumbbells with that weight. The user then exercise with those dumbbells. When the user desires to use dumbbells of a different weight, he returns the ones he was using to a rack or storage place and selects different dumbbells with the weight he desires.

There are dumbbells which have connecting devices so that the dumbbell can be connected to the end of a barbell. In this case, the dumbbell is used as a weight on the barbell. The user will typically place his hands on the barbell with the entire dumbbell being positioned outside of the hands of the person exercising.

BRIEF SUMMARY OF THE INVENTION

The current invention includes at least two dumbbells having first and second weights positioned on first and second ends of a dumbbell handle. At least one of these weights is referred to as the connector weight and includes a dumbbell connector portion. The dumbbell connector portion is aligned axially with the dumbbell handle. A barbell has barbell connector portions on the left and right axial ends of the barbell, and the barbell connector portions engage the dumbbell connector portions. When the barbell and dumbbell are joined by engaging the dumbbell and barbell connector portions, the dumbbells serve as the weights on the barbell. In one embodiment, the dumbbell connector portion is positioned in a recess in the dumbbell weight such that the barbell connector portion fits into the recess to engage the dumbbell connector portion.

DETAILED DESCRIPTION

Dumbbell

Figure 1:
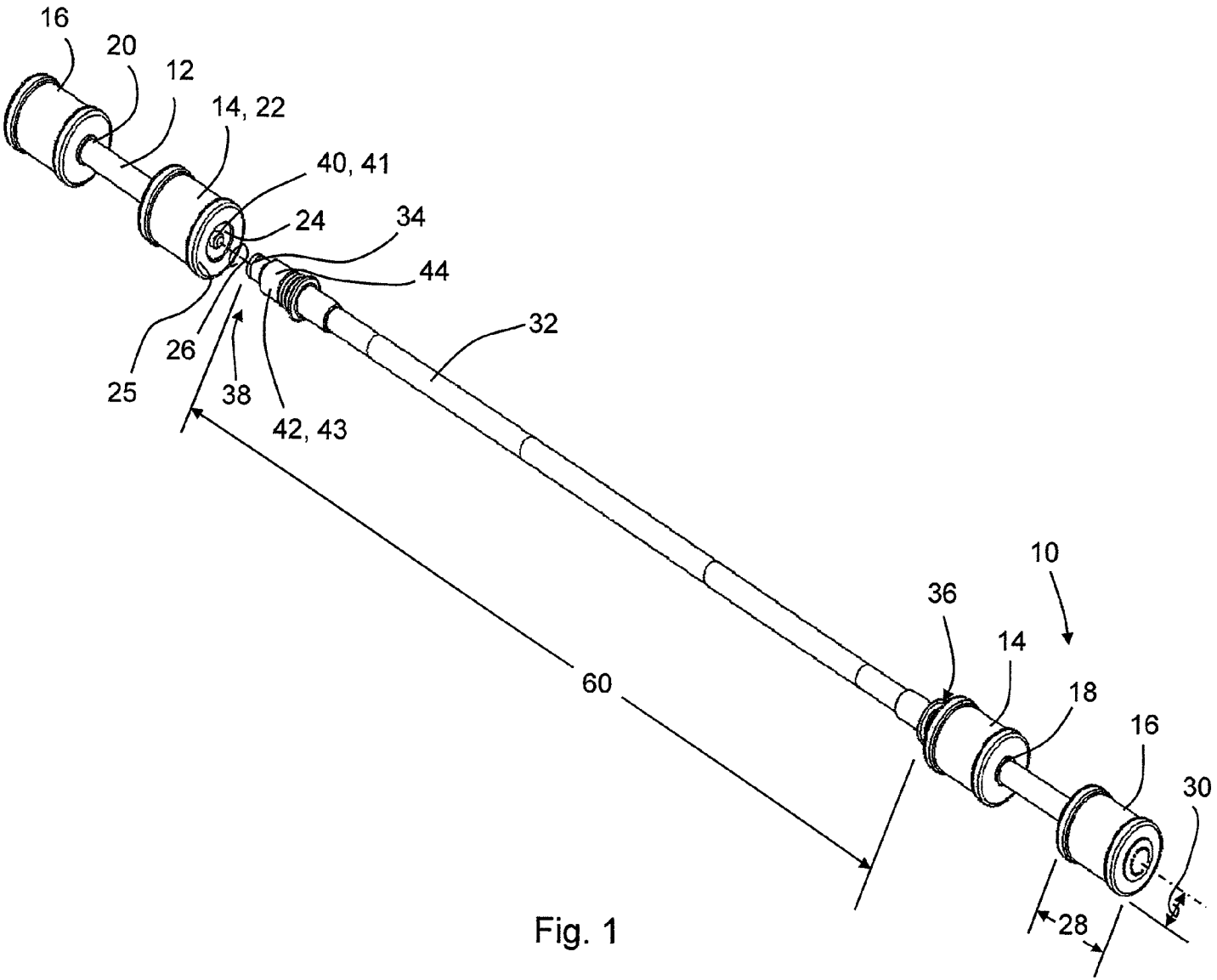
FIG. 1 is a perspective view of a barbell and two dumbbells. One of the dumbbells is connected to the barbell.
Figure 2:
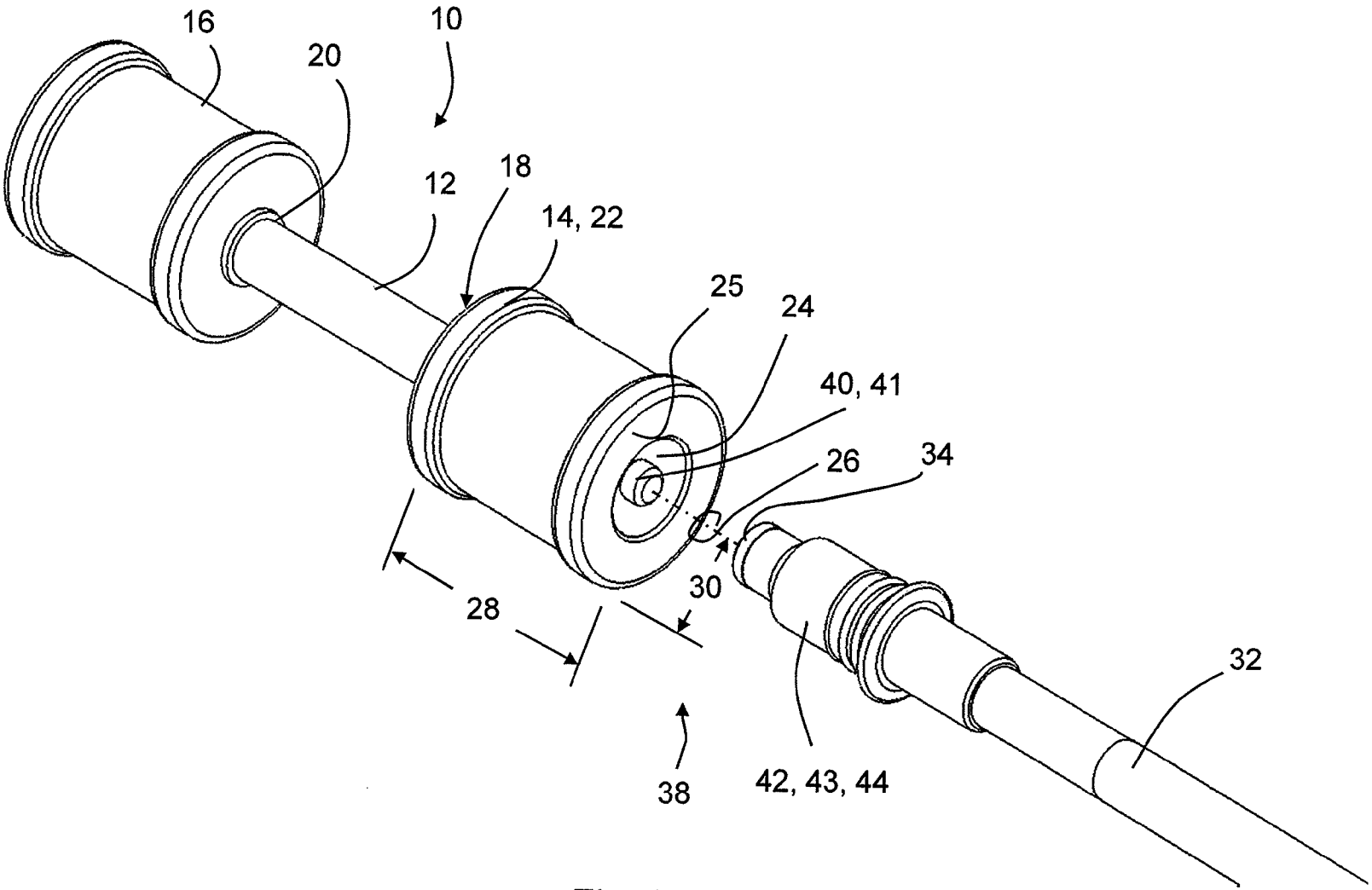
FIG. 2 is perspective view of a dumbbell and one end of the barbell wherein the barbell is in position to be connected to the dumbbell.

A dumbbell 10 of the current invention is shown in FIGS. 1 and 2. The dumbbell 10 has a handle 12 which is positioned between a first weight 14 and a second weight 16. The first weight 14 is connected to a first axial end 18 of the handle 12 and the second weight 16 is connected to a second axial end 20 of the handle 12. At least one of the first weight 14 and the second weight 16 is referred to as a connector weight 22. In FIGS. 1 and 2, the first weight 14 is shown as the connector weight 22, but it is possible for the second weight 16 to also be a connector weight 22, such that both weights 14, 16 are connector weights 22.

The connector weight 22 should include a recess 24 in an end 25 of the connector weight 22 axial with the dumbbell handle 12. The connector weight 22 includes the recess 24, but it is also possible for the second weight 16 to include a recess 24, even if the second weight 16 is not used as a connector weight 22. The recess 24 is positioned axially with the dumbbell handle 12, so an axis 26 of the dumbbell handle 12 would also be an axis 26 of the recess 24. The first and second weights 14, 16 should have approximately the same size and weight so that the dumbbell 10 feels balanced in the user's hand, and the dumbbell 10 does not appear uneven to a person exercising. Because of this, in the preferred embodiment, the second weight 16 does include a recess 24 to facilitate the first and second weights 14, 16 having approximately the same size and weight. Even if the second weight 16 does not have a recess 24, it should have about the same size and weight of the first weight 14.

The first and second weights 14, 16 are preferably cylindrical in shape such that each weight has a length 28 and a radius 30. For the connector weight 22 to accommodate the recess 24 it is preferred that the connector weight 22 be relatively long, such that the weight length 28 is at least as long as the weight radius 30. This structure allows for a recess 24 in the connector weight 22, but it also facilitates use of the dumbbell 10. Because the first and second weights 14, 16 have a relatively small radius 30, the weights 14, 16 have less of a tendency to contact and interfere with the user's wrist and arm as the user manipulates the dumbbell 10.

Dumbbells 10 with a fixed weight are generally provided in sets such that there are a set of two dumbbells 10 for each of a plurality of weights. For example, there might be two dumbbells 10 that weigh five pounds, two more dumbbells 10 that weigh ten pounds, two that weight fifteen pounds, two that weight twenty pounds, etc. This allows the user to select the amount of weight desired by choosing the set of dumbbells 10 with the desired weight.

Frequently, dumbbells 10 are stored on a rack in an exercise room. One type of rack includes a base and two supports which extend upwards from the base. The supports have notches which are dimensioned to receive the dumbbell handles 12, and the notches are spaced apart to accommodate one particular weight of dumbbell 10. The radius 30 of a dumbbell 10 generally corresponds to the weight of the dumbbell 10, so dumbbells 10 with a smaller radius 30 weight less. Therefore, notches which are spaced further apart accommodate heavier dumbbells 10, and notches which are spaced closer together accommodate lighter dumbbells 10.

The preferred rack design uses the gaps between notches to minimize back strain and associated injuries for the user. When a user bends over to pick something up from near ground level, a relatively large strain is placed on the back, and less strain is placed on the back when a user picks up an object close to the body at about waist level. An intermediate amount of strain is placed on the back when picking something up from above the waist. Therefore, the rack gaps are designed such that the lightest dumbbells 10 are positioned closest to the ground, and the heaviest dumbbells 10 are positioned near waist level, which is about three feet. Medium weight dumbbells 10 are stored above waist level, if the support extends that high.

Connector and Barbell

The barbell 32 is basically a rod or bar which can be either straight or curved. The barbell 32 has a left axial end 34 and a right axial end 36, and may include texturing on the main body of the barbell 32 to facilitate gripping. The left and right axial ends 34, 36 will generally face opposite directions. The barbell 32 has to be strong enough to support the weight which is utilized for exercise purposes. The barbell 32 of the current invention includes at least two connectors 38 to connect the barbell 32 with the dumbbells 10. Usually, there is a threaded opening in the axial ends 34, 36 of the barbell 32, and a bolt can be threaded into this opening to attach the connector 38 to the barbell ends 34, 36.

Each connector 38 generally includes two parts: a male portion 40 and a female portion 42. One portion of the connector 38 is received in the recess 24 of the connector weight 22, whereas the other portion of the connector 38 is received on the axial ends 34, 36 of the barbell 32. The connector portion received in the recess 24 of the connector weight 22 is referred to as the dumbbell connector portion 41, and the connector portion received on the axial ends 34, 36 of the barbell 32 is referred to as the barbell connector portion 43. If the dumbbell 10 does not include a recess, the dumbbell connector portion 41 is received on at least one of the weights 14, 16 axially, so when engaged the dumbbell handle 12 would be axial with the barbell 32.

It is generally preferred that the male portion 40 be received in the recess 24 of the connector weight 22 with the female portion 42 on the axial ends 34, 36 of the barbell 32, but it is also possible for this position to be reversed. If the female portion 42 is received in the recess 24 such that the female portion 42 essentially is the recess 24, the male portion 40 on the barbell 32 would enter into the recess 24 when the male portion 40 engaged the female portion 42. If the male portion 40 is received in the recess 24, weight is preferably principally born by the male connector portion 40, and not by the inner walls of the recess 24.

Preferably, the dumbbell connector portion 41 is received in the recess 24 so it does not protrude and thereby create a tripping or stumbling hazard for the user. The recess 24 should be deep enough to prevent the dumbbell connector portion 41 from extending past the connector weight end 25, but it is also possible for the dumbbell connector portion 41 to protrude somewhat. Although it is not required, the dumbbell 10 can include two connector weights 22 so the dumbbell could be connected to the barbell 32, then disengaged from the barbell 32, rotated 180°, and reconnected to the barbell 32.

When the male and female connector portions 40, 42 are engaged, the barbell connector portions 43 are dimensioned such that these they fit within the recess 24 of the connector 22. The barbell connector portion 43 enters the connector weight recess 24 and engages the dumbbell connector 38 portion. A wide variety of connectors can be used, but a quick connect is preferred. A quick connect is different than a standard threaded connection such as a nut and a bolt. In the standard quick connect, the male and female portions 40, 42 are not rotated as they are engaged; the male and female portions 40, 42 are pushed directly together without any rotation during the engaging process. It is possible to rotate the male and female connectors 40, 42 as they are engaged, but this is generally not necessary.

Figure 3:
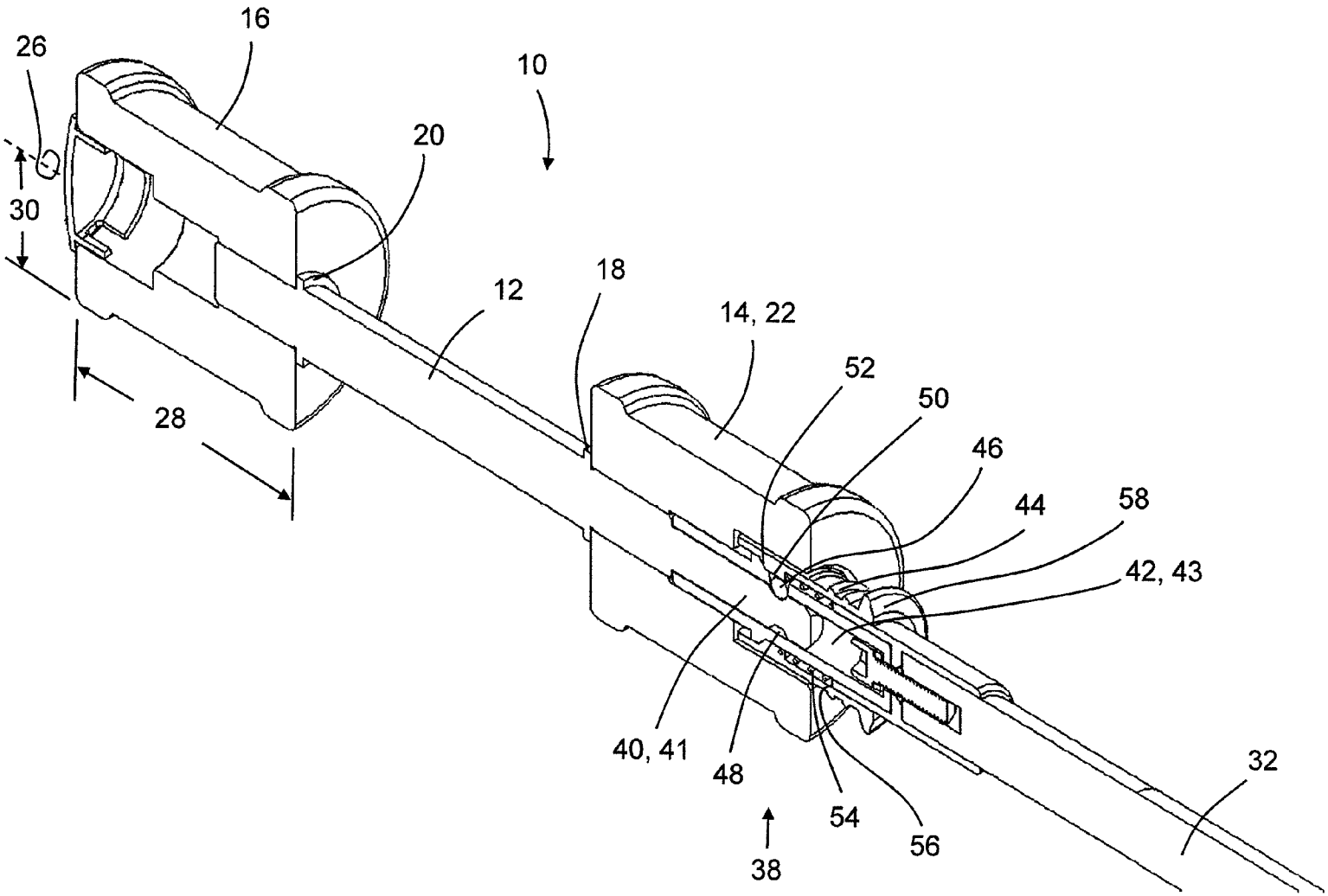
FIG. 3 is a section perspective view of a dumbbell and one end of the barbell when the dumbbell and barbell are connected.

The preferred connector is shown in more detail in FIGS. 2 and 3. It is be understood that different types of connectors 38 could be used, and even different types of quick connect connectors 38 could be used. In this description, the male connector portion 40 is in the dumbbell recess 24, and the female portion 42 is on the axial ends 34, 36 of the barbell, but these positions could be reversed.

The quick connect connector 38 allows for simple, rapid attachment and separation of the dumbbells 10 and the barbell 32. The female portion 42 is received on the axial ends 34, 36 of the barbell 32, and includes a retractable collar 44 with at least one locking ball 46 positioned underneath the retractable collar 44. Preferably there are a plurality of locking balls 46. The male portion 40 in the dumbbell recess 24 includes an annular groove 48 into which the locking balls 46 are received when the connector 38 is engaged. The female portion 42 includes a support surface 50 adjacent to a sloped surface 52, and one of these surfaces 50, 52 contacts the locking ball 46. When the connector 38 is engaged, the locking ball 46 abuts the support surface 50 such that the locking ball 46 is held in the annular groove 48 of the male connector portion 40. However, when the retractable collar 44 is pulled backwards towards the center of the barbell 32, the support surface 50 slides past the locking ball 46 and the sloped surface 52 becomes positioned over the locking ball 46. When the sloped surface 52 is above the locking ball 46, the locking ball 46 is able to move radially outward from the dumbbell handle axis 26. This motion allows the locking ball 46 to retract from the annular groove 48 such that male and female connector portions 40, 42 become disengaged and the dumbbell 10 can be removed from the barbell 32.

The position of the retractable collar 44 determines if the female connector portion 42 is in a locked or engaged position. A spring 54 is utilized to urge the retractable collar 44 outwards away from the center of the barbell 32 into a locked position. To engage the female and male portions 42, 40, the retractable collar 44 is pulled against the tension of the spring 54 until the sloped surface 52 is contacting the locking balls 46. The female connector usually has a stop 56 which prevents the retractable collar 44 from being pulled back further than necessary. The retractable collar 44 preferably has a shoulder 58 which facilitates grasping and moving the retractable collar 44, and this shoulder 58 is positioned so it can be reached when the male and female portions 40, 42 are engaged. When the retractable collar 44 is pulled back, the male and female portions 40, 42 are pushed together, and then the retractable collar 44 is released. The tension from the spring 54 pushes the retractable collar forward such that the support surface 50 becomes positioned above the locking balls 46. To disengage the connector 38, the retractable collar 44 is pulled, and the dumbbell 10 and barbell 32 are separated.

Dumbbell and Barbell Use

Preferably when the current invention is used, two dumbbells 10 having approximately the same weight are connected on opposite ends 34, 36 of the barbell 32, as seen in FIGS. 1 and 2. This produces an assembled unit, which is then lifted and maneuvered for the purpose of exercise. One embodiment of the current invention includes a relatively short barbell 32, such that the person exercising grasps the assembled unit by the dumbbell handles 12 when exercising. The shorter barbell 32 has a length 60, and the maximum length 60 should be approximately eighteen (18) inches, and may even be as short as approximately sixteen (16) inches. This allows for a smaller, shorter piece of exercise equipment which does not take up as much room as a longer piece of exercise equipment.

The use of a shorter barbell 32 has several advantages. A shorter assembled unit is less likely to become entangled or catch on items close to the person exercising. This design also positions the connector weights 22 between the hands of the user with the second weights 16 on the outside of the user's hands. This results in a more balanced assembled unit, because some of the weight is transferred to a more central point. The improved balance reduces the tendency for the assembled unit to tilt, resulting in a safer device.

The design of the weights also provides benefits to the user. Many exercise weights have a radius which is significantly larger than the weight length, unlike the current invention. The relatively short radius 30 of the current invention allows for the person exercising to maneuver the assembled unit with less interference from the weights 14, 16 contacting the user's wrist and arms. This is true if a dumbbell 10 is used independently, or if two dumbbells 10 are used when connected to a barbell 32. The short weights 14, 16 are also aesthetically pleasing.

In one embodiment, a plurality of barbells 32 having different barbell lengths 56 are provided such that a user selects the barbell 60 desired. A user might select a relatively long barbell length 60 for some exercises in which the position of the hand moves during the exercise. The user may select a longer barbell length 60 if several different exercises will be performed successively and the different exercises require different hand positions, or if the planned exercise requires the hands to be at a position other than the dumbbell handle 12 position on the short barbell 32. A straight barbell 32 with a longer length 60 allows the user to place their hands anywhere along the barbell 32, so such a barbell 32 can be used for a wide variety of exercises.

Weights can be positioned closer to the point a user grasps a barbell 32 if shorter weights are used. Many standard barbells 32 have a length of 32 inches between the inner collars or weights, but shorter weights allow for use of a shorter barbell 32 because the user's hands can be positioned closer to the weights without interfering with the exercises. Therefore, the shorter weights 14, 16 allow for a shorter "long" barbell 32. The long barbell 32 of the current invention can be approximately 25 inches and still be used for the same exercises as the standard 32 inch barbell 32. The shorter length 60 is preferable because it allows use in smaller areas, provides less resistance to motion when the barbell ends 34, 36 are moved perpendicular to the barbell length 60, and provides less of a hazard for catching the barbell 32 on objects during use. The shorter "long" barbell 32 is also easier to store and generally manipulate than a longer "long" barbell 32.

When the shorter barbell 32 is used, the user's hands are mostly restricted to the position of the dumbbell handles 12, similar to some existing curved barbells 32 where the curves of the barbell 32 dictate the position of the hands. The shorter barbell 32 may be preferred because it is less awkward and more balanced than the longer barbell 32. The shorter barbell 32 is also easier to use for the same reasons the approximately 25 inch barbell 32 is easier to use than the standard 32 inch barbell 32, as discussed above.

When the user selects a barbell 32 with a given length 60, the user also selects dumbbells 10 with a given weight to be connected to the barbell 32. A selection of dumbbells 10 are provided in sets of two having approximately the same weight, and a plurality of sets of dumbbells 10 are provided at a plurality of weights. This gives the user a variety of weight options for the barbell 32. When a plurality or dumbbells 10 and a plurality of barbells 32 are provided, a plurality of connectors 38 are used as needed. These dumbbells 10 are then connected to the axial ends of the barbell 34, 36 and the user begins exercising with the assembled barbell 32 and dumbbells 10.

While the invention has been described with respect to a limited number of embodiments, those skilled in the art, having the benefit of this disclosure, will appreciate that other embodiments can be devised which do not depart from the scope of the invention as disclosed here. Accordingly, the scope of the invention should be limited only by the attached claims.

I claim:

1. An apparatus for exercising comprising:

a plurality of barbells having left and right axial ends and a length, wherein at least one of the barbells has a length not more than 18 inches;

a plurality of dumbbell sets, wherein each dumbbell set includes 2 dumbbells having approximately the same weight, and wherein each dumbbell includes a first weight, a second weight, and a handle having first and second axial ends, wherein the first and second weights are connected to the first and second axial ends of the dumbbell handle, wherein the first and second weights are cylindrical such that each weight has a length and a radius, wherein the length is at least as long as the radius, wherein at least one of the first and second weights comprises a connector weight, and wherein the connector weight includes a recess axial with the dumbbell handle;

a plurality of quick connect connectors, wherein each quick connect connector includes a male portion and a female portion, and the male connector portions are received in the connector weight recesses, and wherein the female connector portions are received on the barbell axial ends, and wherein the female connector portions received on the barbell axial ends are dimensioned to enter the connector weight recesses and therein engage the male connector portions by direct pushing without rotation.

2. An apparatus for exercising comprising:

a dumbbell including a first weight, a second weight, and a handle having first and second axial ends, wherein the first and second weights are connected to the first and second ends of the dumbbell handle, wherein at least one of the first and second weight comprises a connector weight, and wherein the connector weight includes a recess axial with the dumbbell handle; and a dumbbell connector portion received in the connector weight recess, where the connector portion further comprises a portion of a quick connect connector, where the quick connect connector couples by direct pushing without rotation.

3. The apparatus of claim 2 wherein the dumbbell includes at least 2 two dumbbells, the apparatus further comprising:

a barbell having left and right axial ends; and barbell connector portions received on the barbell axial ends, wherein the barbell connector portions engage the dumbbell connector portion by direct pushing without rotation, and wherein the barbell connector portions are dimensioned to enter the connector weight recess to engage the dumbbell connector portion therein.

4. The apparatus of claim 3 wherein the barbell connector portion further comprises a female portion of a quick connect connector and the dumbbell connector portion further comprises a male portion of a quick connect connector.

5. The apparatus of claim 4 wherein the quick connect connector further comprises a retractable collar, and wherein the quick connect connector is disengaged by pulling on the retractable collar and separating the dumbbell and barbell.

6. The apparatus of claim 3 wherein the barbell has a maximum length of 18 inches.

7. The apparatus of claim 3 wherein the at least two dumbbells includes a set of two dumbbells having approximately the same weight, wherein there are a plurality of sets of dumbbells at a plurality of weights, and wherein the barbell has a length and the barbell includes a plurality of barbells having different lengths.

8. The apparatus of claim 2 wherein the first and second weights are cylindrical.

9. The apparatus of claim 8 wherein the first and second weights have a length and a radius, and wherein the length is at least as long as the radius.

10. An apparatus for exercising comprising:

at least 2 dumbbells, wherein each dumbbell includes a first weight, a second weight, and a handle having first and second axial ends, wherein the first weight is connected to the first axial end and the second weight is connected to the second axial end;

a barbell having left and right axial ends and a length, wherein the barbell length is not more than 18 inches; and at least two connectors wherein each connector comprises a dumbbell connector portion and a barbell connector portion, wherein the dumbbell connector portions are received on at least one of the first and second weights, wherein the barbell connector portions are received on the left and right ends of the barbell, and wherein the dumbbell and barbell connector portions engage such that the dumbbell handle is axial with the barbell.

11. The apparatus of claim 10 wherein at least one of the first and second weights comprises a connector weight, the connector weight includes a recess axial with the handle, the dumbbell connector portion is received in the recess of the connector weight, and wherein the connectors are quick connect connectors which engage by direct pushing without rotation.

12. The apparatus of claim 10 wherein the dumbbell connector portion is a male portion of a quick connect connector which engages by direct pushing without rotation.

13. The apparatus of claim 12 wherein the quick connect connector further comprises a retractable collar, and wherein the quick connect connector is disengaged by pulling the retractable collar and separating the dumbbell and barbell.

14. The apparatus of claim 10 wherein the first and second weights are cylindrical.

15. The apparatus of claim 14 wherein the first and second weights have a length and a radius, and the length is at least as long as the radius.

16. The apparatus of claim 10 wherein the at least two dumbbells includes a set of two dumbbells having approximately the same weight, wherein there are a plurality of sets of dumbbells at a plurality of weights, and wherein the barbell includes a plurality of barbells having different lengths.

* * * * *